US009721490B2

(12) United States Patent
Yang et al.

(10) Patent No.: US 9,721,490 B2
(45) Date of Patent: Aug. 1, 2017

(54) DUAL-SCREEN DISPLAY AND DISPLAY METHOD

(71) Applicants: Beijing Lenovo Software Ltd, Beijing (CN); Lenovo (Beijing) Co., Ltd, Beijing (CN)

(72) Inventors: Guang Yang, Beijing (CN); Ke Shang, Beijing (CN); Quan Niu, Beijing (CN)

(73) Assignees: Beijing Lenovo Software Ltd., Beijing (CN); Lenovo (Beijing) Co., Ltd., Beijing (CN)

( * ) Notice: Subject to any disclaimer, the term of this patent is extended or adjusted under 35 U.S.C. 154(b) by 0 days.

(21) Appl. No.: 14/348,239

(22) PCT Filed: Jan. 9, 2013

(86) PCT No.: PCT/CN2013/070268

§ 371 (c)(1),
(2) Date: Mar. 28, 2014

(87) PCT Pub. No.: WO2013/107318

PCT Pub. Date: Jul. 25, 2013

(65) Prior Publication Data

US 2014/0247198 A1 Sep. 4, 2014

(30) Foreign Application Priority Data

Jan. 16, 2012 (CN) ..... 2012 1 0013273

(51) Int. Cl.
*G09G 3/00* (2006.01)
*G09G 3/36* (2006.01)
*G09G 3/3208* (2016.01)

(52) U.S. Cl.
CPC ..... *G09G 3/003* (2013.01); *G09G 3/3208* (2013.01); *G09G 3/36* (2013.01);
(Continued)

(58) Field of Classification Search
CPC ..... G09G 3/003; G09G 3/3208; G09G 3/36; G09G 2320/0606; G09G 2340/0492; G09G 2300/023
(Continued)

(56) References Cited

U.S. PATENT DOCUMENTS 6,771,020 B1 8/2004 Wang
7,015,989 B2 3/2006 Kim et al.
(Continued)

FOREIGN PATENT DOCUMENTS

CN 1492260 A 4/2004
CN 1532596 A 9/2004
(Continued)

OTHER PUBLICATIONS

1st Chinese Office Action regarding Application No. 201210013273.0, dated Feb. 4, 2015.
(Continued)

*Primary Examiner* — Stephen Sherman
(74) *Attorney, Agent, or Firm* — Harness, Dickey & Pierce, P.L.C.

(57) ABSTRACT

A dual-screen display and a display method. The dual-screen display comprises: a display unit, a control unit and controllable light-transmitting bodies. Each display unit comprises at least three sub-pixel units. The controllable light-transmitting bodies are distributed on an upper surface and a lower surface of the sub-pixel units. The control unit is used for controlling, according to an instruction of a user, a control signal applied to the controllable light-transmitting bodies, so as to control the transparency of the controllable light-transmitting bodies. The controllable light-transmitting bodies are distributed on the two surfaces of the sub-pixel unit, and a control signal is applied according to an instruction of the user, so that the controllable light-transmitting
(Continued)

bodies present corresponding transparency, thereby respectively controlling light of the sub-pixel unit irradiated to the two surfaces.

8 Claims, 2 Drawing Sheets

(52) U.S. Cl.
CPC ..... *G09G 2300/023* (2013.01); *G09G 2320/0606* (2013.01); *G09G 2340/0492* (2013.01)

(58) Field of Classification Search
USPC ..... 345/4
See application file for complete search history.

(56) References Cited

U.S. PATENT DOCUMENTS

| | | | | |
|---|---|---|---|---|
| 7,230,585 | B2 | 6/2007 | Wakefield | |
| 7,391,485 | B2 | 6/2008 | Kim et al. | |
| 8,174,489 | B2 | 5/2012 | Sorensson et al. | |
| 2004/0080468 | A1 | 4/2004 | Wakefield | |
| 2004/0183960 | A1 | 9/2004 | Kim et al. | |
| 2004/0246412 | A1 | 12/2004 | Kim et al. | |
| 2005/0001796 | A1* | 1/2005 | Liu | G02B 6/0038 345/87 |
| 2005/0073512 | A1* | 4/2005 | Liu | G09G 3/20 345/204 |
| 2006/0038752 | A1 | 2/2006 | Winters | |
| 2008/0002083 | A1 | 1/2008 | Kwon et al. | |
| 2008/0088755 | A1 | 4/2008 | Kwan | |
| 2008/0199667 | A1* | 8/2008 | Cho | 428/212 |
| 2008/0303982 | A1* | 12/2008 | Jin | G02F 1/1335 349/69 |
| 2009/0091613 | A1* | 4/2009 | Louwsma et al. | 348/51 |
| 2009/0231662 | A1 | 9/2009 | Sorensson et al. | |
| 2011/0115996 | A1 | 5/2011 | Lin et al. | |
| 2011/0148944 | A1* | 6/2011 | Kobayashi | G09G 3/3225 345/690 |
| 2011/0286073 | A1* | 11/2011 | Lo et al. | 359/290 |
| 2012/0013972 | A1* | 1/2012 | Gibson et al. | 359/296 |
| 2012/0019434 | A1* | 1/2012 | Kuhlman | G02F 1/13306 345/1.3 |
| 2012/0242943 | A1* | 9/2012 | Sun et al. | 349/144 |

FOREIGN PATENT DOCUMENTS

| | | | |
|---|---|---|---|
| CN | 1567042 | A | 1/2005 |
| CN | 1752800 | A | 3/2006 |
| CN | 1799023 | A | 7/2006 |
| CN | 101158781 | A | 4/2008 |
| CN | 101604502 | A | 12/2009 |
| CN | 101645246 | A | 2/2010 |
| CN | 201438250 | U | 4/2010 |
| CN | 101960373 | A | 1/2011 |
| EP | 1515181 | A1 | 3/2005 |
| GB | 2384609 | A | 7/2003 |
| WO | WO 02071131 | A2 * | 9/2002 |

OTHER PUBLICATIONS

International Search Report (in Chinese and English) and Written Opinion (in Chinese) for PCT/CN2013/070268, mailed Apr. 11, 2013; ISA/CN.

Second Chinese Office Action regarding Application No. 201210013273.0 dated Aug. 17, 2015. English translation provided by Unitalen Attorneys at Law.

Fourth Chinese Office Action regarding Application No. 201210013273.0 dated Jul. 21, 2016.

First German Office Action regarding Application No. 112013000581.6 dated Jul. 28, 2016. English translation provided by Unitalen Attorneys at Law.

Third Chinese Office Action regarding Application No. 201210013273.0 dated Feb. 1, 2016. English translation provided by Unitalen Attorneys at Law.

* cited by examiner

DUAL-SCREEN DISPLAY AND DISPLAY METHOD

This application is a national phase application of PCT/CN2013/070268, filed on Jan. 9, 2013, which claims priority to Chinese Patent Application No. 201210013273.0 filed with Chinese Patent Office on Jan. 16, 2012, each of which is incorporated herein by reference in its entirety.

FIELD

The disclosure relates to the field of display, and in particular to a dual-screen display device and a display method.

BACKGROUND

With the development of life, the demand for dual-screen display is increasing. Conventionally, two separate display devices are connected together to form a dual-screen display device for display. However, connection of two displays of the dual-screen display device results in a complicate structure and high cost.

An Organic Light-Emitting Display (hereinafter referred to as OLED) is often used in the dual-screen display device for display. Images are displayed on both an upper screen and a lower screen of the OLED when OLED emits light in both upper and lower directions. However, the images displayed on the two screens are identical and uncontrollable.

SUMMARY

A dual-screen display device with a simple structure and low cost is provided by an embodiment of the disclosure.

A dual-screen display device is provided according to an embodiment of the disclosure. The dual-screen display device includes:

a display unit, a control unit and transparence-controllable bodies, where the display unit includes at least three sub-pixel units;

the transparence-controllable bodies are disposed on an upper side and a lower side of the sub-pixel unit respectively; and the control unit is configured to control a control signal applied on the transparence-controllable body based on a user instruction, to control transparence of the transparence-controllable body.

A display method applied to a dual-screen display device is further provided by the disclosure. The dual-screen display device includes a display unit. The display unit includes at least three sub-pixel units. The method includes:

receiving a user instruction;

controlling a control signal applied on transparence-controllable bodies based on the instruction, wherein the transparence-controllable bodies are disposed on an upper side and a lower side of the sub-pixel unit; and displaying based on the instruction.

By the dual-screen display device and the display method of the disclosure, dual-screen display with a simple structure and low cost can be achieved.

BRIEF DESCRIPTION OF THE DRAWINGS

Technical solutions of embodiments of the disclosure are described below in detail in conjunction with accompanying drawings. It should be understood that the accompanying drawings in the following description only describe part of embodiments of the disclosure. Those skilled in the art can obtain other drawings from these drawings without any creative effort.

DETAILED DESCRIPTION

The technical solutions of the embodiments of the disclosure will be described below clearly and fully with reference to the accompanying drawings. Apparently, the described embodiments are only part but not all of embodiments of the disclosure. Based on the embodiments of the disclosure, those skilled in the art can obtain other embodiments.

In the disclosure, control of light emitted to two screens of a display device is achieved by using transparence-controllable bodies, thereby achieving dual-screen display of the display device. In this way, the cost is saved, the controllability of the dual-screen display is achieved, and thus user experience is improved.

Figure 1:
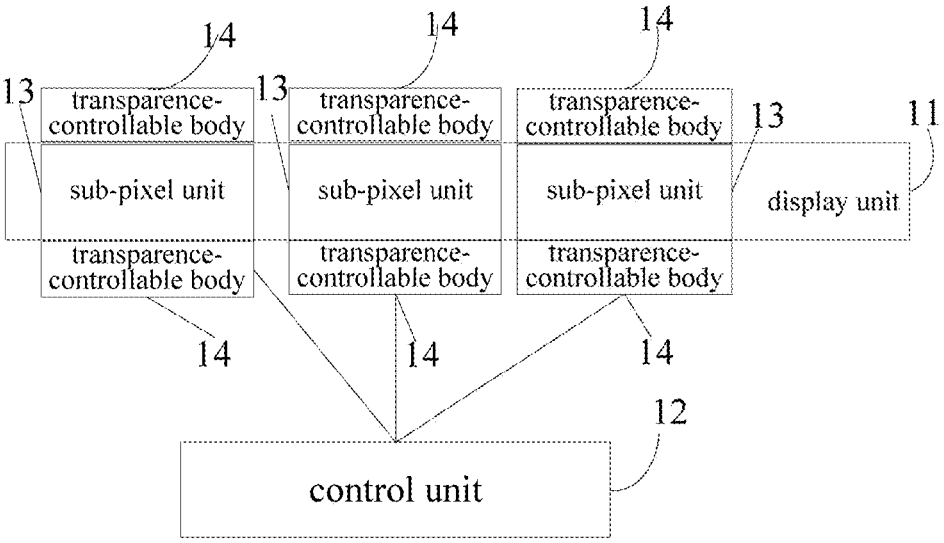
FIG. 1 is a schematic diagram of a dual-screen display device according to a first embodiment of the disclosure.

A dual-screen display device is provided by a first embodiment of the disclosure. Referring to FIG. 1, the dual-screen display device includes a display unit 11, a control unit 12 and transparence-controllable bodies 14.

In the disclosure, there may be one or more display unit 11.

Each display unit 11 includes at least three sub-pixel units 13.

Each sub-pixel unit 13 corresponds to one color. In the embodiment of the disclosure, each display unit includes three sub-pixel units which correspond respectively to red, green and blue.

The transparence-controllable bodies 14 are distributed on upper sides and lower sides of the sub-pixel units 13.

Transparence of the transparence-controllable body 14 is controllable. A control signal, such as an electrical signal or a magnetic signal, may be used to control the transparence of the transparence-controllable body 14.

In the disclosure, the transparence-controllable body refers to a substance whose molecule arrangement varies with the control signal applied on the transparence-controllable body. The control signal herein includes an electrical signal, a magnetic signal, or the like. The electrical signal is taken as an example below for illustration. Different transparence-controllable bodies have different transparences. For some transparence-controllable bodies, before they are powered on, their molecule arrangement are uniform, which blocks light and results in poor transparence; and after they are powered on, their molecules are gathered to one end, which allows light to pass and results in good transparence. On the contrary, some transparence-controllable bodies have opposite performance. Common transparence-controllable body may be materials such as liquid crystal, electronic ink or the like. Take the liquid crystal as an example, in the case that the liquid crystal is powered on, its molecule arrangement becomes uniform and it is easy for light to pass; and in the case that the liquid crystal is not powered on, its molecule arrangement is disordered, which blocks the light.

Therefore, the transparence-controllable body functions like a strobe, which blocks light or allows light to pass.

The control unit 12 may control a control signal applied on the transparence-controllable bodies 14 based on a user instruction, to control transparences of the transparence-controllable bodies and thus control display of the display unit 11.

The control unit 12 is connected to the transparence-controllable bodies 14. The control unit 12 may control an electric signal output to the transparence-controllable bodies 14 from a power supply and may also control a magnetic signal output to the transparence-controllable bodies 14 from a magnetic field signal source. In an embodiment of the disclosure, the electric signal may be a voltage signal or a current signal. A power supply providing the electric signal to the transparence-controllable bodies 14 and the power supply providing the electric signal to the display unit 11 may be a same power supply. Additionally, it should be noted that the controlling a control signal applied on the transparence-controllable bodies 14 may include applying different control signals or applying no control signal.

Take an OLED display device as an example. In this OLED display device, the light of the sub-pixel unit 13 is emitted to the upper side and the lower side, and the control unit 12 controls the transparences of the transparence-controllable bodies 14 by controlling the control signal applied on the transparence-controllable bodies 14. Thus, the light of the sub-pixel unit 13 emitted to the upper side and the lower side is controlled respectively, that is, the light is controlled to pass through, pass through partly or not pass through the transparence-controllable body 14. In this way, the dual-screen display is achieved.

Figure 2:
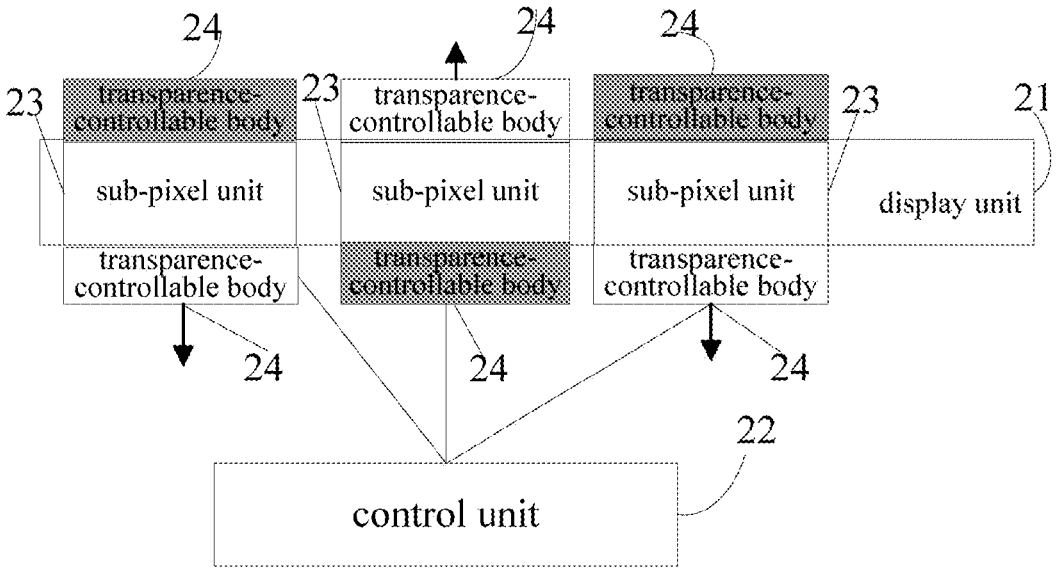
FIG. 2 is a schematic diagram of a dual-screen display device according to a second embodiment of the disclosure.

FIG. 2 illustrates a second embodiment of the disclosure, which shows states of the transparence-controllable bodies 24 in the case that different images are displayed on the two screens. In FIG. 2, the dual-screen display device has the same structure as that in FIG. 1, which is not described in detail herein.

If the user instruction is to display different images on the two screens of the display device, the control unit 22 may control the transparence-controllable bodies 24 on the upper side and the low side of any of the sub-pixel units 23 to have the strongest transparence and the weakest transparence respectively, and meanwhile control the transparence-controllable bodies 24 on a same side of the alternate sub-pixel units 23 to have the same transparences.

Specifically, based on the transparence of the transparence-controllable body 24, the control unit 22 applies a control signal to the transparence-controllable body 24 on one side of the sub-pixel unit 23, to make the transparence-controllable body 24 have the strongest transparence, i.e. to make the light pass through the transparence-controllable body maximally. As shown in FIG. 2, the light is allowed to maximally pass through the transparence-controllable body 24 above the middle sub-pixel unit. The control unit 22 applies a control signal to the transparence-controllable body 24 on the other side of the sub-pixel unit to make the transparence-controllable body 24 have the weakest transparence, i.e. to make the light be blocked maximally. As shown in FIG. 2, the transparence-controllable body 24 below the middle sub-pixel unit blocks the light maximally. In this way, the light of one sub-pixel unit 23 only passes through one side, and the corresponding color is only displayed on the screen on this side. Meanwhile, the control unit 22 makes the transparence-controllable bodies 24 on a same side of alternate sub-pixel units 23 have the same transparence by applying control signals. As shown in FIG. 2, the control unit 22 makes the transparence-controllable bodies 24 above the sub-pixel units at the two sides of the middle sub-pixel unit have the same transparence, and makes the transparence-controllable bodies 24 below the sub-pixel units at the two sides of the middle sub-pixel have the same transparence. In this way, the color of the adjacent sub-pixel units 23 is displayed on screens on the opposite sides. Thus, different images may be displayed on the two screens of the display device.

Figure 3:
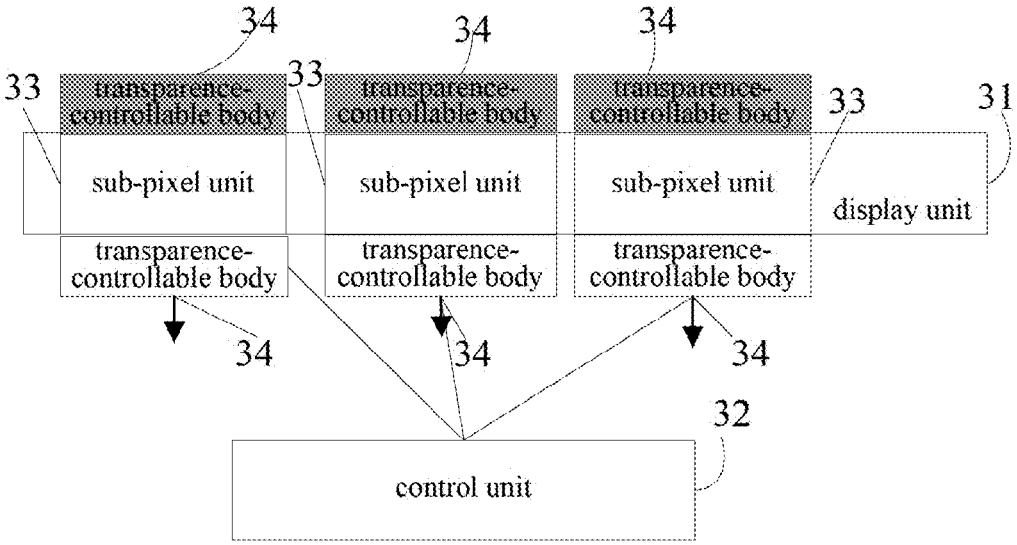
FIG. 3 is a schematic diagram of a dual-screen display device according to a third embodiment of the disclosure.

FIG. 3 illustrates a third embodiment of the disclosure, which shows states of the transparence-controllable bodies 34 in the state that the image is displayed on only one screen. In FIG. 3, the dual-screen display device has the same structure as that in FIG. 1, which is not described in detail herein.

If the user instruction is to use only one screen and close the other screen, the control unit 32 may control the transparence-controllable bodies 34 distributed on a same side of the sub-pixel units 33 to have the strongest transparence, thereby displaying the image on this side. Meanwhile, the control unit 32 controls the transparence-controllable bodies 34 distributed on the other side of the sub-pixel units 33 to have the weakest transparence, thereby closing the screen on this side.

Specifically, based on the transparence of the transparence-controllable body 34, the control unit 32 applies the same control signals on the transparence-controllable bodies 34 on a same side of the sub-pixel units 33, to make the transparence-controllable bodies 34 on this side have the strongest transparence. As shown in FIG. 3, transparence-controllable bodies below the sub-pixel units have the strongest transparence. Meanwhile, the control unit 32 applies the same control signals on the transparence-controllable bodies 34 on the other side of all the sub-pixel units 33, to make the transparence-controllable bodies 34 on this side have the weakest transparence. As shown in FIG. 3, the transparence-controllable bodies above the sub-pixel units have the weakest transparence. In this way, the image is displayed only on the screen at the side of the transparence-controllable bodies having the strongest transparence, and no image is displayed on the screen on the other side as the light is blocked.

In the above embodiment, when the transparence-controllable body has the weakest transparence, the light emitted to this transparence-controllable body can not pass through this transparence-controllable body. In this case, the light may be absorbed by the transparence-controllable body depending on the nature of the transparence-controllable body.

In a preferred embodiment of the disclosure, the transparence-controllable body may be a material with controllable reflectivity. The control unit applies a control signal to make the transparence-controllable body have reflectivity while making the transparence-controllable body have the weakest transparence. In this way, the light emitted to this transparence-controllable body is reflected to the other side of the sub-pixel unit opposite to the transparence-controllable body, thus the display on the other side is enhanced and light waste is avoided.

In a fourth embodiment of the disclosure, if the user wants to change the brightness of the screen, the control unit may control the transparence-controllable bodies on a corresponding side of the sub-pixel units to have a corresponding transparence. Specifically, if the brightness of one screen is required to be decreased by half, the control unit may apply a corresponding electrical signal to the transparence-controllable bodies on a side of sub-pixel units corresponding to this screen based on the transparences of the transparence-controllable bodies, to make the transparence-controllable bodies be translucent, that is, a half of light is allowed to pass.

In other embodiment of the disclosure, all the transparence-controllable bodies may be controlled to have the strongest transparence, to display the same image on both sides; or all the transparence-controllable bodies may be controlled to have the weakest transparence, so that no image is displayed on both sides.

It should be noted that, the above described embodiments are only part of the preferred embodiments of the disclosure. In other embodiments, the control unit may control the transparence-controllable bodies to have stronger or weaker transparence. For example, the control unit may control the transparence-controllable bodies to make 90% or 80% of the light pass through the transparence-controllable bodies by applying a control signal, and an image is also seen on the screen at the corresponding side. Alternatively, the control unit makes the transparence-controllable bodies block 90% or 80% of the light by applying a control signal, and an image can not be seen on the screen at the corresponding side.

In other embodiment of the disclosure, it is also possible to perform hybrid display, such as transparent display or opaque display, on part regions of the display device by applying different control signals to the transparence-controllable bodies on different sides of different sub-pixel units based on the user instruction.

Figure 4:
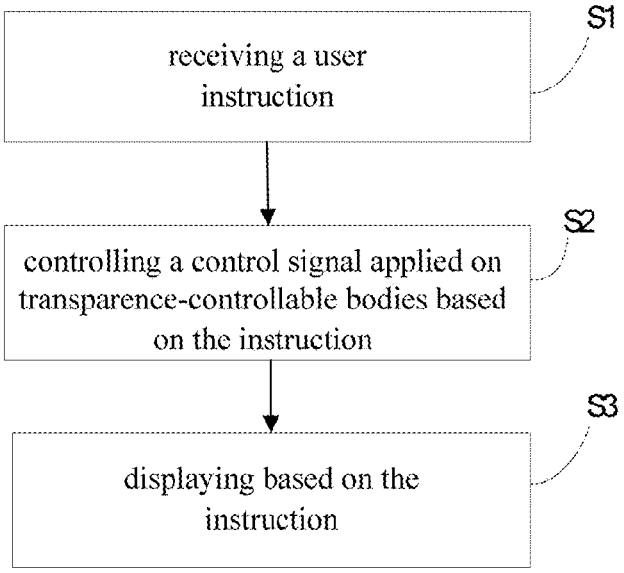
FIG. 4 is a flow chart of a display method according to a fifth embodiment of the disclosure.

A display method applied to a dual-screen display device is provided according to a fifth embodiment of the disclosure. The dual-screen display device includes a display unit, and each display unit includes at least three sub-pixel units. Referring to FIG. 4, the method includes steps S1-S3.

S1 is receiving a user instruction.

S2 is controlling a control signal applied on transparence-controllable bodies based on the instruction, where the transparence-controllable bodies are disposed on the upper side and the lower side of the sub-pixel unit.

S3 is displaying based on the instruction.

In one embodiment of the disclosure, the step of controlling a control signal applied on transparence-controllable bodies based on the instruction includes:

controlling the transparence-controllable bodies on the upper side and the lower side of any of the sub-pixel units to have the strongest transparence and the weakest transparence respectively and meanwhile controlling the transparence-controllable bodies on the same side of alternate sub-pixel units to have the same transparence, based on the instruction.

In another embodiment of the disclosure, the step of controlling a control signal applied on transparence-controllable bodies based on the instruction includes:

controlling the transparence-controllable bodies distributed on a same side of the sub-pixel units to have the strongest transparence and meanwhile controlling the transparence-controllable bodies distributed on the other side of the sub-pixel units to have the weakest transparence, based on the instruction.

In the above described embodiment, if the transparence-controllable bodies have the weakest transparence, the light may be absorbed by the transparence-controllable bodies depending on the nature of the transparence-controllable bodies.

In a preferred embodiment of the disclosure, the transparence-controllable body may be a material with controllable reflectivity. While the transparence-controllable body has the weakest transparence, a control signal may be applied to make the transparence-controllable body has reflectivity. In this way, the light emitted to this transparence-controllable body is reflected to the other side of the sub-pixel unit opposite to the transparence-controllable body, thus the display on the other side is enhanced and light waste is avoided.

In another embodiment of the disclosure, the step of controlling a control signal applied on transparence-controllable bodies based on the instruction includes:

controlling the transparence-controllable bodies distributed on a same side of the sub-pixel units to be translucent.

It should be noted that the method embodiment of the disclosure corresponds to the device embodiment of the dual-screen display device of the disclosure, so the method embodiment is not described in detail herein, and the relevant part may refer to the device embodiment.

Moreover, in the disclosure, the transparence-controllable bodies may be distributed on only one side of the sub-pixel units of display unit, and thus only one screen of the dual-screen display device is controlled. In this way, different display of two screens can also be achieved. In a case that the transparence-controllable bodies are only distributed on one side of the sub-pixel units, the method for controlling the transparence-controllable bodies is the same as the method in the embodiments described above, which is not described in detail herein.

The dual-screen display device and the display method provided by the embodiments of the disclosure are described above. Specific examples are used to set forth the principles and embodiments of the disclosure. Description of the above embodiments is only used to help understanding of the device and method of the disclosure; and modifications can be made to those embodiments and applications by those skilled in the art according to the ideal of the disclosure. Therefore, the content of this disclosure should not be construed as limit of the disclosure.

The invention claimed is:

1. A display device, comprising:

a display unit, a control unit, and transparence-controllable bodies, wherein the display unit comprises at least three sub-pixel units, each of the at least three sub-pixel units has a first side and a second side;

the transparence-controllable bodies are disposed on a first side and a second side of each individual sub-pixel unit of the at least three sub-pixel units; and the control unit is configured to control a control signal applied on the transparence-controllable bodies based on a user instruction, to control transparencies of the transparence-controllable bodies, wherein the control unit is configured to control the transparence-controllable bodies on the first side and second side of each individual sub-pixel unit of the at least three sub-pixel units to have a first transparence and a second transparence, and control the transparence-controllable bodies respectively on two adjacent sub-pixel units by a same side of the two adjacent sub-pixel units to have different transparences to display two different images on two screens.

2. The display device according to claim 1, wherein the transparence-controllable bodies include materials with controllable reflectivity, and the control unit is further configured to control the transparence-controllable bodies having the second transparence to have reflectivity.

3. The display device according to claim 1, wherein the control unit is configured to control the transparence-controllable bodies on the first side or the second side of the first one of every N sub-pixel units to have a third transparence.

4. The display device according to claim 3, wherein the third transparence is a transparence that causes a half of light to pass through the transparence-controllable body.

5. A display method applied to a display device, the display device comprising a display unit, and the display unit comprising at least three sub-pixel units, wherein the method comprises:

receiving a user instruction;

controlling a control signal applied on transparence-controllable bodies based on the user instruction, wherein each of the at least three sub-pixel units has a first side and a second side, the transparence-controllable bodies are disposed on a first side and a second side of each individual sub-pixel unit of the at least three sub-pixel units, wherein a control unit is configured to control the transparence-controllable bodies on the first side and the second side of each individual sub-pixel unit of the at least three sub-pixel units to have a first transparence and a second transparence, and control the transparence-controllable bodies respectively on two adjacent sub-pixel units on a same side of the two adjacent sub-pixel units to have different transparences to display two different images on two screens; and displaying based on the user instruction.

6. The method according to claim 5, further comprising:

controlling the transparence-controllable bodies having the second transparence to have reflectivity.

7. The method according to claim 5, wherein controlling the control signal applied on the transparence-controllable bodies based on the user instruction comprises:

controlling the transparence-controllable bodies on the first side or the second side of the first one of every N sub-pixel units to have a third transparence.

8. The method according to claim 7, wherein the third transparence is a transparence that causes a half of light to pass through the transparence-controllable bodies.

* * * * *